United States Patent [19]

Bush

[11] Patent Number: 5,020,667

[45] Date of Patent: Jun. 4, 1991

[54] PORTABLE HAZARDOUS WASTE PALLET STRUCTURE

[76] Inventor: Harry Bush, 8330 Manchester Rd., St. Louis, Mo. 63144

[21] Appl. No.: 402,662

[22] Filed: Sep. 5, 1989

[51] Int. Cl.[5] ..... B65D 19/00

[52] U.S. Cl. ..... 206/386; 206/596; 206/599; 108/51.1; 108/55.1

[58] Field of Search ..... 206/386, 596, 598, 599; 220/DIG. 6, 1.5; 108/51.1, 53.1, 53.5, 55.1; 126/152 R, 152 B, 167

[56] References Cited

U.S. PATENT DOCUMENTS

| | | | |
|---|---|---|---|
| 91,949 | 6/1869 | Mahony | 126/167 |
| 234,047 | 11/1880 | Maitland | 126/167 |
| 254,688 | 3/1882 | Parkinson | 126/167 |
| 3,511,191 | 5/1970 | Barry, Jr. et al. | 108/51.1 |
| 3,720,176 | 3/1973 | Munroe | 108/53.1 |
| 3,944,070 | 3/1976 | Cardwell et al. | 206/596 |
| 3,948,190 | 4/1976 | Cook, III et al. | 108/53.3 |
| 3,995,749 | 12/1976 | Haskins | 206/599 |
| 4,015,715 | 4/1977 | Kelf | 206/386 |
| 4,029,023 | 6/1977 | Rosewicz et al. | 108/51.1 |
| 4,122,761 | 10/1978 | Westin et al. | 220/1.5 |
| 4,185,956 | 1/1980 | Balster | 126/167 |
| 4,361,232 | 11/1982 | Olmsted | 206/386 |
| 4,407,878 | 10/1983 | Smith et al. | 108/51.1 |
| 4,413,737 | 11/1983 | Wind | 206/599 |
| 4,838,178 | 6/1989 | Chriske et al. | 108/51.1 |
| 4,848,617 | 7/1989 | Zygaj | 220/1.5 |
| 4,930,632 | 6/1990 | Eckert et al. | 206/386 |

FOREIGN PATENT DOCUMENTS

| | | | |
|---|---|---|---|
| 8301243 | 4/1983 | European Pat. Off. | 206/599 |
| 2918573 | 11/1980 | Fed. Rep. of Germany | 206/599 |
| 2101971 | 1/1983 | United Kingdom | 206/599 |

*Primary Examiner*—David T. Fidei

*Attorney, Agent, or Firm*—Polster, Polster and Lucchesi

[57] ABSTRACT

An improved portable pallet structure for supporting material carrying containers including a confined chamber having a plurality of access passages separate from the confined chamber to accommodate lifting members and including a material pervious support platform mounted above the confined chamber whereby materials spilled from containers supported thereby are collected in the confined chamber.

7 Claims, 2 Drawing Sheets

PORTABLE HAZARDOUS WASTE PALLET STRUCTURE

BACKGROUND OF THE INVENTION

The present relates to an improved portable pallet structure, and more particularly, to a unique and novel pallet structure capable of accommodating and firmly supporting heavy containers, particularly those carrying hazardous materials from which flow such liquids or small particulates.

Various types of pallet structures are known in the art for supporting heavy material containers, such pallet structures including accommodating passages for the insertion of liftingforks to allow the pallet structures to be moved from one location to another. For the most part these past pallet structures have been comparatively complex in manufacture and assembly and have failed to accommodate adequately for container spill, particularly in those situations where the containers are filled with hazardous and/or corrosive materials. Where the prior art does accomplish this purpose, it does so only with expensive constructions.

The present invention, recognizing the need to provide an economical to manufacture and assemble pallet structure which accommodates for material spill and yet which is readily accessible for movement of heavy containers to be supported on the pallet structure, provides such a unique and novel pallet structure which fulfills such recognized needs and which at the same time can be manufactured and assembled in an economical manner with a minimum of materials and manufacturing steps. The pallet structure of the present invention not only accommodates for spill of flowable materials from containers, but accommodates for such materials even if they are hazardously corrosive, the inventive structure being capable of stably supporting heavy containers filled with flowable materials, particularly those of a hazardous nature, the novel structure having a large fill capacity for spilled materials, which spilled materials can be distributed uniformly in a confined container space when spilled in large quantities. Further, the novel structure of the present invention provides for multiple fork lift entry in a low profile arrangement which can be readily loaded and unloaded and which can readily incorporate supplemental support structure for the container support platform when needed.

Various other features of the present invention will become obvious to one skilled in the art upon reading the disclosure herein.

SUMMARY OF THE INVENTION

More particularly, the present invention provides a portable pallet structure for material carrying containers including: confined chamber means defined by bottom and side wall members with the side wall members extending in a generally vertical direction from the bottom wall member, said side wall members being shaped to provide a plurality of access passages separate from the confined chamber means to permit insertion of pallet lifting means; and, pervious container support platform means mounted in cooperative relation with the side wall members and in spaced relation above the bottom wall member whereby flowable materials spilled from containers supported thereby are collected in the confined chamber means. In addition, the present invention provides a novel support structure for the pervious container support platform including a removable supplemental platform support as well as novel arrangements for utilizing such platform and supplemental supports to direct spill flow in a selected manner.

It is to be understood that various changes can be made by one skilled in the art in one or more of the several parts of the novel pallet structure disclosed without departing from the scope or spirit of the present invention. For example, the general pallet structure could be circular rather than rectangular and include more or fewer confined subchambers than as disclosed. Further, the pervious support platform could be an appropriately apertured, foraminous plate with funnel shaped, flow directing apertures and supported in a different manner from the disclosed internal ledge, for example, a plurality of supplemental supports.

BRIEF DESCRIPTION OF THE DRAWINGS

Referring to the drawings which disclose one advantageous embodiment of the invention.

DETAILED DESCRIPTION OF THE DRAWING

Figure 1:
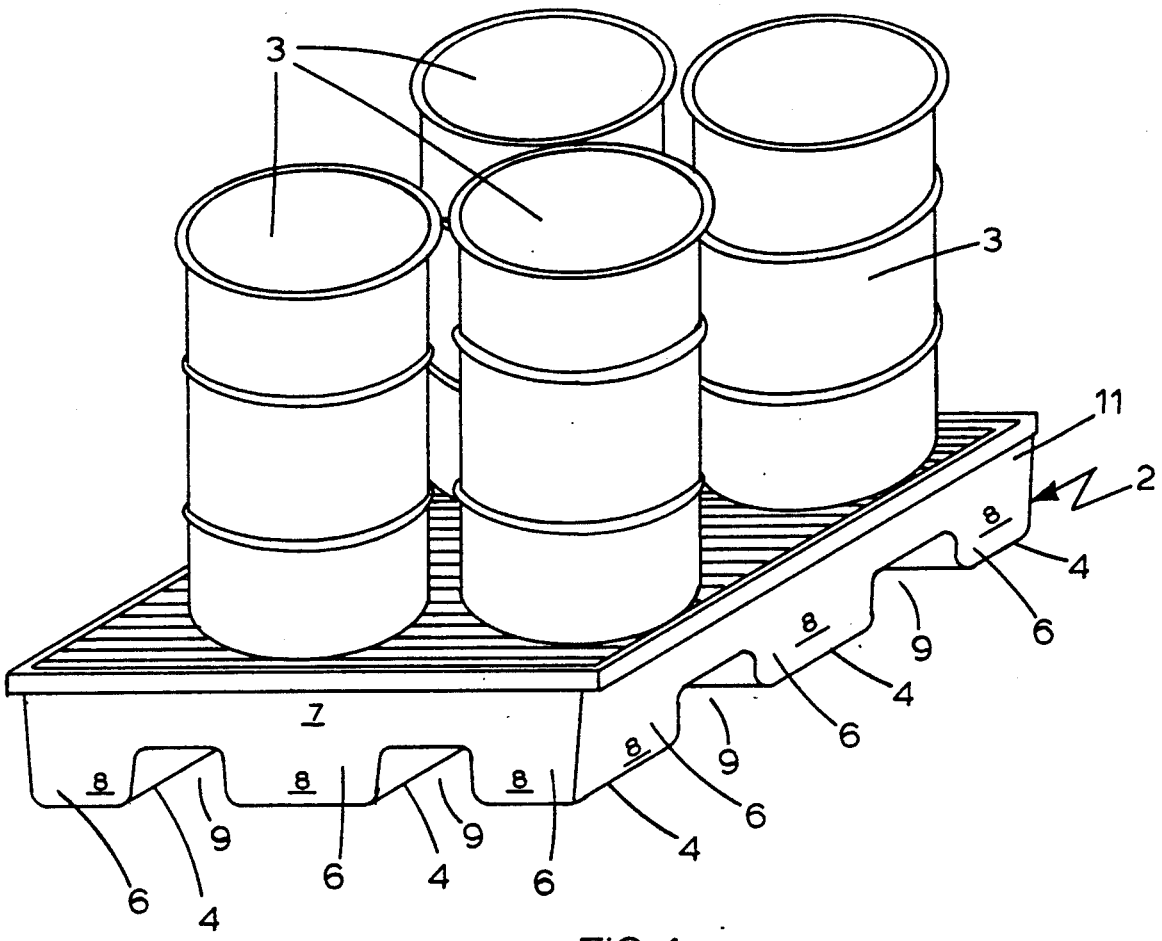
FIG. 1 is an isometric view of the novel portable pallet structure supporting material carrying containers in the form of four cylindrical drums.

As can be seen in FIG. 1 of the drawings, the novel portable pallet structure 2 is disclosed as supporting a plurality of containers or drums 3 suitable for filling with any one of a number of materials to be stored, including liquids and granular materials, some of which can be of a hazardous nature. Pallet structure 2 includes an integral bottom of bottom wall members 4 and side wall members 6 advantageously formed as an integral unit from a suitable corrosion-resistant polyethylene material with the side wall members extending in a generally vertical direction from the bottom wall members 4. These bottom and side wall members are shaped to define a confined chamber 7 which is of rectangular shape in the disclosed embodiment of the invention and includes a plurality of spaced rows of confined subchambers 8 with rows of access passages 9 extending therebetween in crossing relation separate from the spaced subchambers 8. This arrangement permits insertion of pallet lifting means, such as a lift fork (not shown) from any one or more of the sides of the confined chamber 7, thus permitting multiple lift entry. It is to be noted that the outer of the side wall members 6 extends upwardly beyond the defined subchambers 8 to further define an upper rectangular peripheral skirt 11, providing an upper common chamber portion 12 (FIGS. 2–4) which extends over and in communication with spaced subchambers 8.

Figure 2:
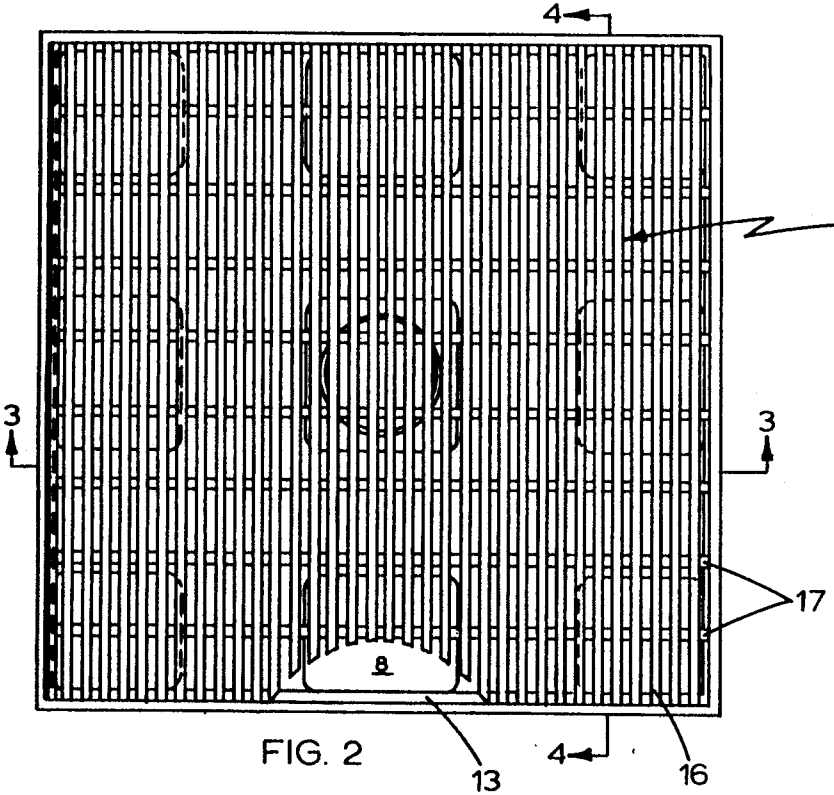
FIG. 2 is a top plan view of the pallet structure of FIG. 1 with the support platform partially broken away to better illustrate the internal support ledge therefor.
Figure 4:
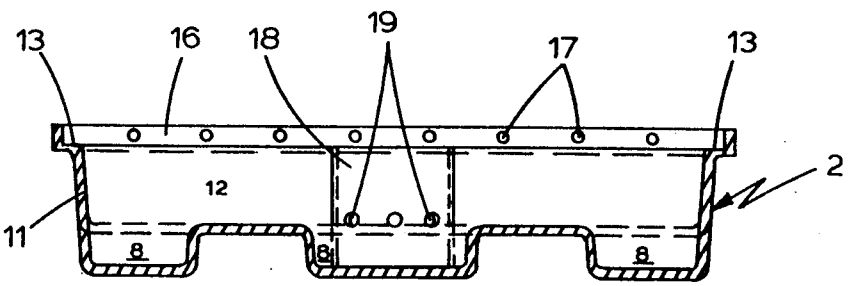
Figure 3:
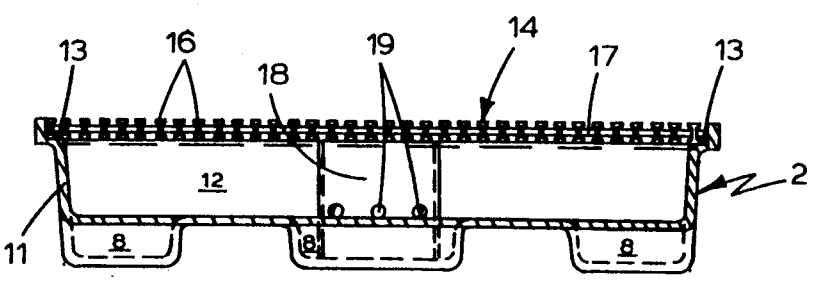
FIG. 3 is a cross-sectional view of the pallet structure of FIG. 2, taken in a plane through line 3—3 of FIG. 2; and, FIG. 4 is a cross-sectional view of the pallet structure of FIG. 2, taken in a plane through line 4—4 of FIG. 2.

As also can be seen in FIGS. 2–4, upper peripheral skirt 11 is formed or shaped to include a peripherally extending internal support edge or lip 13 which serves to support the peripheral edge of a grating serving as a pervious container support platform 14.

Pervious container support platform 14 or grating can be formed from a suitable corrosion-resistant fiberglass material to include a first set of spaced bars 16 of I-shaped cross-section (FIG. 3) and a second set of spaced bars 17 of circular cross-section (FIG. 4) crossing in normal relation to and interconnected with the set of bars 16. Although not shown in detail in the drawings, these bars, like the base portions of I-shaped cross-sectional bars 16 and the downwardly and oppositely sloping upper portions of circular cross-sectional bars 17, can be contoured or shaped in other words to selectively direct any spilled material from containers 3 to flow through the upper spaced bars 16 and 17 into the common chamber portion 12 to the confined subchambers 8 in a more uniform manner, platform or grating 14 being sized so that the peripheral edges thereof rest on the internal support ledge 13 of peripheral skirt 11.

As also can be seen in FIGS. 2–4 of the drawings, a removable supplementary or secondary support can be provided for the pervious container support platform 14. Advantageously, this secondary support can be formed from a suitable corrosion-resistant polyvinyl material as a cylindrical container or tube 18 sized to be removably disposed within the central subchamber of the nine subchambers 8 disclosed as serving to provide the plurality of spaced rows of confined subchambers. Tube 18 includes a ring of spaced apertures 19 along the upper portion thereof so as to allow spilled materials therein to flow to the surrounding subchamber and or subchambers 8. It is to be noted that tube 18 is positioned and sized in both height and breadth to provide an undersupport for platform or grating 14. That is to say, platform 14 spans a relatively short free distance in any longitudinal direction before it meets some form of undersupport. This is an important feature of my invention, because it enables the entire structure to be lighter in weight than constructions which require or have longer free spans before meeting the undersupport. In this regard, it is further to be noted that although only one such supplementary or secondary support container 18 is disclosed, it would be possible to use a plurality of such containers, depending upon the number of subchambers included in the pallet and/or the nature of the load to be supported by platform or grating 14.

From the above description, it can be seen that a unique and novel low profile, readily loadable and unloadable pallet structure is provided which is comparatively straightforward and economical in manufacture and assembly, which can be adapted to handle varying loads of flowing material, particularly those of a hazardous nature, with a minimum of waste loss and a minimum of sloshing in the event of a spill.

The invention claimed is:

1. A portable pallet structure for material carrying containers comprising:

a confined rectangular chamber defined by integral corrosion-resistant polyethylene bottom and side wall members with the side wall members extending in a generally vertical direction from the bottom wall members shaped so that said confined chamber includes a plurality of spaced rows of confined subchambers with rows of access passages extending therebetween in crossing relation separate from said confined subchambers to permit insertion of container lifting means from any side of said confined rectangular chamber, said side wall members further defining an upper peripheral skirt providing an upper common confined chamber portion extending over and in communication with said subchambers, said peripheral skirt being shaped to include a peripherally extending internal support ledge;

a corrosion-resistant fiberglass grating serving as a pervious container support platform including first and second sets of spaced bars with the spaced bars of said sets being interconnected in cross relation and shaped to selectively direct spilled material flow through said upper common confined chamber portion to said confined subchambers, said grating being sized so that the peripheral edges thereof rest on said peripherally extending internal support ledge of said peripheral skirt; and, a secondary corrosion-resistant polyvinyl or polyethylene support tube sized to be removably disposed within the central subchamber of said plurality of spaced rows of confined subchambers, said secondary support container including a plurality of apertures therein to allow spilled materials therein to flow to said surrounding subchambers and being positioned and sized to provide an undersupport for said grating thereabove.

2. A pallet for containing as hazardous spill comprising:

a confined chamber means including a corrosion-resistant, non-porus wall member bottom and at least one side wall member, said side wall member extending generally vertically upwardly from said bottom wall member and shaped so that said chamber means includes a plurality of subchambers with at least one set of access passages extending therebetween to permit insertion of a pallet lifting means, said side wall member further defining an upper peripheral skirt, said skirt being shaped to include a support ledge;

a corrosion-resistant porous removable container support member mounted to said chamber means, said support member being sized so that the peripheral edge thereof rests on said support ledge; and, at least one secondary under support removably mounted in said chamber means and extending between said bottom wall and said container support member, said under support defining an internal volume, said secondary under support including a plurality of apertures therein to allow spilled material to flow between said internal volume and said confined chamber means.

3. A pallet for containing a hazardous spill comprising:

a confined chamber means including a corrosion-resistant, non-porous bottom wall member and at least one side wall member, said side wall member extending generally upwardly from said bottom wall member and shaped so that said chamber means includes a plurality of subchambers with at least one set of access passages extending there between to permit insertion of a pallet lifting means, said side wall member further defining a upper peripheral skirt, said skirt being shaped to include a support ledge;

a corrosion-resistant, porous, removable container support member mounted to said chamber means, said support member being sized so that the peripheral edge thereof rests on said support ledge; and at least one under support mounted in said chamber means and extending between said bottom wall and said container support member, said under support defining an internal volume, said under support including at least one aperture therein to allow spill material to flow between said internal volume and said confined chamber means.

4. The pallet of claim 3 wherein said porous container support member includes a grating shaped to direct flow of spilled materials to said confined chamber means.

5. The pallet of claim 3 wherein said container support member further includes a first set of spaced bars of I-shaped cross section and a second set of space bars of circular cross section crossing in normal relation to and interconnected with said first set of spaced bars to provide a grating shaped to direct for of spilled materials to said confined chamber means.

6. The pallet of claim 5 wherein said container support members constructed form a corrosion-resistant fiberglass grating.

7. The pallet of claim 3 wherein said secondary under support is removably mounted in said chamber means.

* * * * *